US005685088A

United States Patent [19]

Nakamura

[11] Patent Number: 5,685,088

[45] Date of Patent: Nov. 11, 1997

[54] SEALING APPARATUS FOR INLET/OUTLET OF ATMOSPHERE FACILITY

[75] Inventor: Teruhisa Nakamura, Shinnanyo, Japan

[73] Assignee: Nisshin Steel Co., Ltd., Tokyo, Japan

[21] Appl. No.: 592,346

[22] PCT Filed: Jun. 5, 1995

[86] PCT No.: PCT/JP95/01101

§ 371 Date: Feb. 7, 1996

§ 102(e) Date: Feb. 7, 1996

[87] PCT Pub. No.: WO95/33861

PCT Pub. Date: Dec. 14, 1995

[30] Foreign Application Priority Data

Jun. 7, 1994 [JP] Japan ..... 6-125550
Dec. 27, 1994 [JP] Japan ..... 6-326164

[51] Int. Cl.[6] ..... F26B 25/20; F26B 25/06
[52] U.S. Cl. ..... 34/242; 432/242; 277/35
[58] Field of Search ..... 432/242, 244; 34/242; 277/35, 37

[56] References Cited

U.S. PATENT DOCUMENTS 3,291,468 12/1966 Albertsen et al. ..... 432/242
4,981,303 1/1991 Matsushima et al. ..... 277/37
5,456,475 10/1995 Abraham et al. ..... 277/37

OTHER PUBLICATIONS

New U.S. Patent Application filed Feb. 7, 1996 Corresponding to PCT/JP95/01100, filed Jun. 5, 1995, by Teruhisa Nakamura, entitled "Sealing Apparatus for Inlet/Outlet of Atmosphere Heat Treatment Furnace".

*Primary Examiner*—Henry A. Bennett
*Assistant Examiner*—Gregory A. Wilson
*Attorney, Agent, or Firm*—Wenderoth, Lind & Ponack

[57] ABSTRACT

The sealing apparatus of the present invention is intended to enhance the sealing performance and to reduce the rotation loads at the end surfaces of elastic rolls. A sealing apparatus 20 is provided to hermetically seal the inlet/outlet of a bright annealing furnace 22, through which a metal strip 21 is passed. Since the metal strip 21 is held between a pair of elastic rolls 23 on both sides of the strip, the metal strip can be passed through while hermetic sealing is maintained. A covering member 34 and an end surface sealing member 39 made of elastic materials are disposed between the end surface of the elastic roll 23 and the side wall 26 of a casing 25 to attain reliable sealing. A first supporting member 35, a second supporting member 36, an outer bearing 37 and inner bearings 38 made of rigid materials are disposed between the covering member 34 and the end surface sealing member 39 to reduce the rotation loads of the rolls.

12 Claims, 8 Drawing Sheets

SEALING APPARATUS FOR INLET/OUTLET OF ATMOSPHERE FACILITY

BACKGROUND OF THE INVENTION

1. Field of the Invention

The present invention relates to a sealing apparatus for hermetically sealing the inlet and/or the outlet of an atmosphere facility for atmosphere-heat-treating metal strips or for vacuum-evaporating metals or synthetic resins.

2. Description of the Related Art

Conventionally, as shown in FIG. 10, strips such as metal strips are treated continuously in an atmosphere facility. For example, a metal strip 1 is subjected to heat treatment for annealing in a nonoxidizing atmosphere in a vertical bright annealing furnace 2. The metal strip 1 and the bright annealing furnace 2 are grounded electrically by a grounding line 3. The direction of the metal strip 1 is changed by rolls 4 disposed at appropriate positions, and the metal strip 1 enters the bright annealing furnace 2 from a sealed portion 5 of the inlet and is delivered from a sealed portion 6 of the outlet.

The bright annealing furnace 2 continuously anneals the metal strip 1, such as stainless steel strips, other alloy steel strips, high-alloy strips, copper alloy strips and copper strips, while preventing oxidation. For this purpose, a combustible gas having the danger of causing explosions and fires, for example, a gas including hydrogen gas, such as ammonia dissociated gas or a mixture gas of hydrogen and nitrogen, is used as a furnace atmosphere gas 7. Therefore, the sealing performances at the sealed portions 5 and 6 of the inlet or the outlet, respectively, are very important to ensure the quality of products and the safety of operation. The above-mentioned grounding line 3 also functions as a part of safety measures.

A typical prior art of sealing apparatus for sealing an inlet or an outlet is disclosed, for example, in Japanese Examined Patent Publication JPB1 42-18893 (1967). In the prior art, the metal strip 1 is held between a pair of elastic rolls 8 at the sealed portions 5 and 6 of the inlet and the outlet, respectively. A seal plate 9 pushes the outer peripheral side surface of the elastic roll 8 to hermetically seal the boundary between the casing 10 of the bright annealing furnace 2 and each elastic roll 8.

FIG. 11 shows a structure for sealing the end surface of the elastic roll 8 of the above-mentioned prior art. As shown in FIG. 11A, the elastic roll 8 comprises a shaft 11 disposed in the center of the roll, a main roll body 12 made of metal and a rubber covering 13 provided on the outer peripheral surface of the main roll body. At each end of the elastic roll 8 in the axial direction thereof, a rubber washer 14, a friction washer 15 and a metal seal washer 16 are disposed between the end surface of the elastic roll 8 and the side wall of a casing 10. The rubber washer 14 is pushed against the elastic roll 8 in the axial direction thereof so as to hermetically seal the boundary between the end surface of the elastic roll 8 and the side wall of the casing 10. In case the rubber washer 14 is used alone, the washer partially swells and fits in a guide groove 17 for the shaft 11, which is disposed in the casing 10, as shown in FIG. 11B. Since the side wall of the casing 10 is stationary and the elastic roll 8 rotates, in case the rubber washer 14 partially swells as shown in FIG. 11B, the rotation load of the elastic roll 8 is apt to increase and the rubber washer 14 is apt to wear. To prevent this problem, the friction washer 15 made of easily slidable Teflon resin or the like and the metal seal washer 16 are provided.

In the prior art shown in FIG. 11, a variety of washers are disposed between the elastic roll 8 and the side wall of the casing 10 to hermetically seal the end surface of the elastic roll 8. However, it is very difficult to reduce the rotation load of the elastic roll 8 while enhancing the sealing performance at the end of the roll. In case only the rubber washer 14 is used, the rotation load is high, and in case the friction washer 15 and the metal seal washer 16 are used additionally, the rotation load is relatively lower provided that the pushing force of the roll is appropriate. However, although the metal strip 1 appears to travel straight, the strip actually slightly snakes repeatedly. The elastic roll 8 holding the metal strip 1 always receives a thrust force in the axial direction of the roll because of the repulsion force caused by the snaking. Accordingly, the pushing force at the rotating and sliding portion fluctuates. In case the pushing force increases, the sliding resistance between the friction washer 15 and the metal seal washer 16 may also increase. Furthermore, the difference in rotation between the stationary casing and the end surface of the rotating roll is replaced with the sliding friction among the casing, the end surface of the roll and the washers. Since the washers are rubbed at all times, the rotation resistance of the elastic roll is changed by deformation of the washers due to wear or heat generation, and contamination and wear of the metal strip due to generation of friction powder. As a result, the structure has the following disadvantages: tension control in the furnace is disturbed and the shape of the metal strip is deteriorated; static electricity is caused by continuous friction of the washers, thereby causing the danger of ignition due to sparking; stable operation cannot be performed for an extended period of time because of early wear of the washers; the structure is improper for high-speed operation because of friction and deformation due to heat generation; and the sealing performance is lowered when measures for reducing friction at the washers are taken to lower the rotation load and to avoid friction, heat generation and electrostatic charge.

The object of the invention is to provide a sealing apparatus for the inlet and/or the outlet of an atmosphere facility, which is capable of enhancing the sealing performance at the ends of the elastic roll, and of reducing the rotation load of the elastic roll, and is durable even at high speed rotation.

DISCLOSURE OF THE INVENTION

The invention provides a sealing apparatus for hermetically sealing the inlet and/or the outlet of an atmosphere facility for atmosphere-treating a strip while holding the strip between a pair of rolls at least whose outer surface is made elastic, the sealing apparatus comprising:

a casing for enclosing the pair of rolls;

a seal plate for sealing the boundary between the casing and each of the pair of elastic rolls by elastically contacting the outer peripheral surfaces of the pair of elastic rolls;

covering members, formed of an elastic material, comprising a first flange contacting the end surfaces of the rolls and a first sleeve extending outwardly from the outer peripheral surface of the first flange in the axial direction of the rolls, the covering members being incorporated as members of a roll end seal apparatus and disposed on both ends of each roll;

first supporting members disposed on both ends of each roll and formed of a rigid material, each first supporting member comprising a second flange which makes a junction with the outer surface of the first flange, and a second sleeve extending outwardly from the outer peripheral surface of the second flange in the axial direction of the rolls;

second supporting members disposed on both ends of each roll and formed of a rigid material, each second supporting member comprising a third sleeve arranged between the shaft of each roll and the second sleeve outwardly from the second flange in the axial direction of the rolls and a third flange extending from the outer end surface of the third sleeve in the axial direction of the roll to the radial direction of the rolls;

outer bearings each interposed between the third sleeve and the second sleeve, which receive radial and thrust forces, the outer bearing being disposed on both ends of each roll;

inner bearings each interposed between the third sleeve and the shaft of each roll; and an end surface sealing member interposed between the side wall of the casing and the third flange of the second supporting member at both ends of each roll, at least the outward side of which in the radial direction of the roll is formed of an elastic material.

The invention is characterized in that the third flange of the second supporting member has a tapered surface on the outer periphery with the diameter of the surface decreasing in the axially outward direction of the roll.

Furthermore, the invention is characterized in that a lip seal for sealing the boundary between the third sleeve and the second sleeve is provided between the third sleeve of the second supporting member and the second sleeve of the first supporting member outwardly from the outer bearing in the axial direction of the roll.

Furthermore, the invention is characterized in that the outer bearing is a deep-groove ball bearing.

Furthermore, the invention is characterized in that the sealing apparatus comprises means for injecting an inert gas or a gas similar to the atmosphere gas of the furnace (hereinafter often described as "inert gas" generically) into spaces formed inwardly from the portions where the third flanges of the second supporting members, connected to the side wall surface via the end surface sealing member, slidingly contacts the covering members rotating together with the rolls during rotation, via gas passages provided in the shafts of the rolls.

Furthermore, the invention is characterized in that the atmosphere facility is filled with a combustible atmosphere gas including hydrogen gas under a pressure slightly higher than the atmospheric pressure.

Furthermore, the invention is characterized in that the strip is a metal strip and the atmosphere facility is a bright annealing furnace.

Furthermore, the invention is characterized in that the sealing apparatus comprises means for conducting vacuum suction of spaces formed inwardly from the portions where the third flanges of the second supporting members, connected to the side wall surface via the end surface sealing member, slidingly contacts the covering members rotating together with the rolls during rotation, via gas passages provided in the shafts of the rolls.

Furthermore, the invention is characterized in that the atmosphere facility is an organic solvent handling facility operated under a pressure lower than the atmospheric pressure.

Furthermore, the invention is characterized in that the atmosphere facility is a vacuum evaporation furnace.

Furthermore, the invention is characterized in that the covering member and the end surface sealing member are mainly made of elastic members having a specific electric resistance in the range of 1 to $10^7$ Ω·cm.

Furthermore, the invention is characterized in that the elastic member is made of natural rubber, isoprene rubber, SBR, NBR, CR, butyl rubber, polysulfide rubber, silicone rubber, fluororubber, urethane rubber, chlorosulfonic polyethylene, chlorinated polyethylene, butadiene rubber, EPDM, acrylic rubber or hydrin rubber.

According to the invention, the outer peripheries of the pair of elastic rolls are sealed by the seal plates and the casing. To seal both ends of each elastic roll, the covering member made of an elastic material and the end surface sealing member, at least the outward side of which in the radial direction of the roll is formed of an elastic material, are provided. The covering member rotates together with the elastic roll and the tip of the first sleeve performs proper sealing together with the elastic portion of the end surface sealing member and the third flange of the second supporting member. The second flange of the first supporting member made of a rigid material is made contact with the outer surface of the first flange of the covering member, and the first supporting member rotates together with the elastic roll. The second sleeve of the first supporting member transmits the radial force to the third sleeve of the second supporting member via the outer bearing. In addition, the thrust force is transmitted by the outer bearing to the third sleeve via the retaining ring fitted in the groove provided along the outer periphery of the third sleeve or via a stepped portion (not shown) provided along the outer periphery of the third sleeve. The thrust force transmitted to the second supporting portion is received by the end surface sealing member via the third flange of the second supporting member. The radial force transmitted to the second supporting member is received by the shaft of the elastic rotation roll via the inner bearings. In this manner, since the elastic materials contribute to sealing and the bearings reduce rotation loads, the sealing function can be enhanced easily and the rotation loads can be reduced.

Furthermore, according to the invention, since the third flange has a tapered outer periphery, the diameter of which reduces outwardly in the axial direction of the roll, the outer peripheral portion of the end surface sealing member made of an elastic material protrude into the space formed by the tapered surfaces of the third flanges and the end surfaces of the covering members disposed to face each other, whereby proper sealing is attained. Consequently, the amount of flow of the atmosphere gas can be reduced and the production cost for the atmosphere treatment of the strip can be reduced.

Furthermore, according to the invention, since the boundary between the third sleeve and the second sleeve is sealed by the lip seal, the hermeticity between the first supporting member and the second supporting member can be enhanced.

Furthermore, according to the invention, since the deep-groove ball bearing is provided as the outer bearing, for example, a shield type (ZZ type) provided with seals made of steel seals, a non-contact rubber shield type provided with rubber seals (VV type) or a contact rubber shield type provided with rubber seals (DDU type) made by Nippon Seiko can be used. The sealing performance can be enhanced by filling the bearing itself with grease. Moreover, the bearing can receive the thrust and radial forces simultaneously.

Furthermore, according to the invention, since an inert gas can be supplied into the space formed inside the rotating/sliding contact portion of the third flange of the second supporting member contacting the side wall surface via the end surface sealing member and the covering member rotating together with the roll, the atmosphere gas in the atmosphere facility can be securely prevented from leaking, for example, by making the pressure of the inert gas higher than the pressure in the atmosphere furnace.

Furthermore, according to the invention, although the atmosphere facility is filled with a combustible atmosphere gas including hydrogen gas, the atmosphere gas having the danger of causing explosions and fires can be sealed securely from the outside air by enhancing the sealing performance, and safe operation can be performed stably.

Furthermore, according to the invention, since oxygen ($O_2$) and water vapor ($H_2O$) in the outside air (hereinafter sometimes generically referred to as "oxygen") in the outside air can be prevented from entering by securely shutting off the interior of the bright annealing furnace from the outside air, safe operation can be performed stably, and the quality of the metal strip to be subjected to bright annealing is stabilized because coloration due to oxidation does not occur.

Furthermore, according to the invention, since the space formed inwardly from the portion where the third flange of the second supporting member contacting the side wall surface via the end surface sealing member slidingly and rotatingly contacts the covering member rotating together with the roll is subjected to vacuum suction, the outside air can be securely prevented from entering into the furnace, in particular when the atmosphere heat treatment furnace is operated under a pressure lower than the pressure of the outside air.

Furthermore, according to the invention, since the atmosphere facility is an organic solvent handling facility, superior sealing performance can be maintained and safe operation can be performed by conducting vacuum suction of the space formed inwardly from the portion where the third flange slidingly and rotatingly contacts the covering member.

Furthermore, according to the invention, since the atmosphere facility is a vacuum evaporation furnace, superior vacuum conditions can be maintained and high-quality vacuum evaporation can be attained by conducting vacuum suction of the space formed inwardly from the portion where the third flange slidingly and rotatingly contacts the covering member, at the roll end surface.

Furthermore, according to the invention, since the covering member and the end surface sealing member have a specific electric resistance in the range of 1 to $10^7$ Ω·cm, electrostatic charge can be prevented and sparking due to static electricity can be restrained.

Furthermore, according to the invention, since an elastic material such as rubber is used for the covering member and the end surface sealing member, both ends of the roll can be sealed securely.

BEST MODE FOR EMBODYING THE INVENTION

Figure 1:
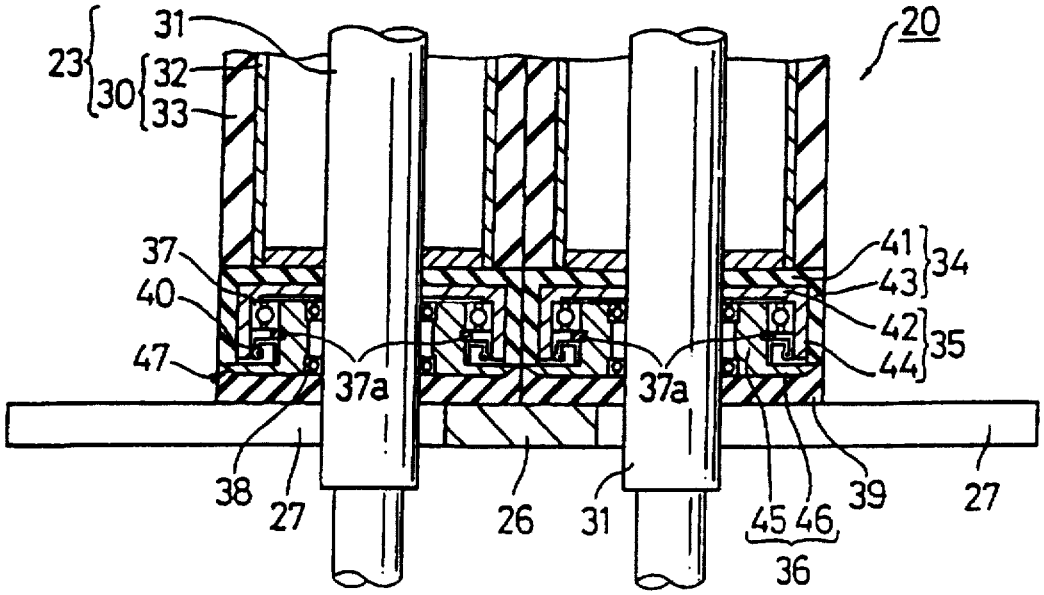
FIG. 1 is a schematic plan sectional view showing a structure of a first embodiment of the invention.
Figure 2:
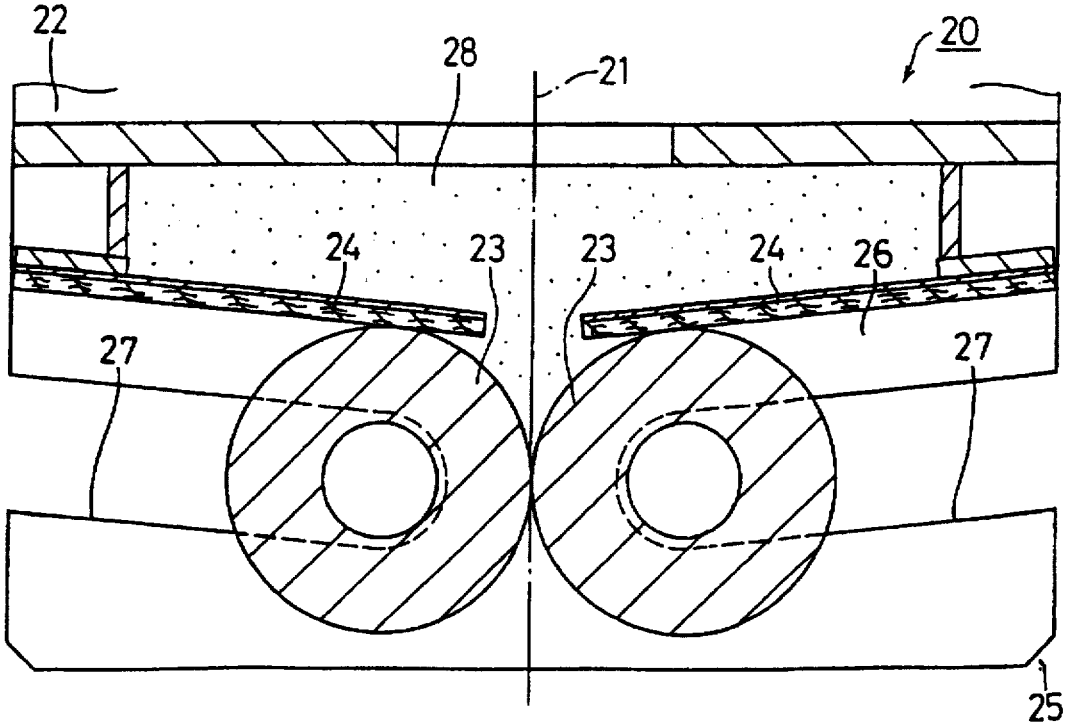
FIG. 2 is a front sectional view showing the embodiment of FIG. 1.
Figure 3:
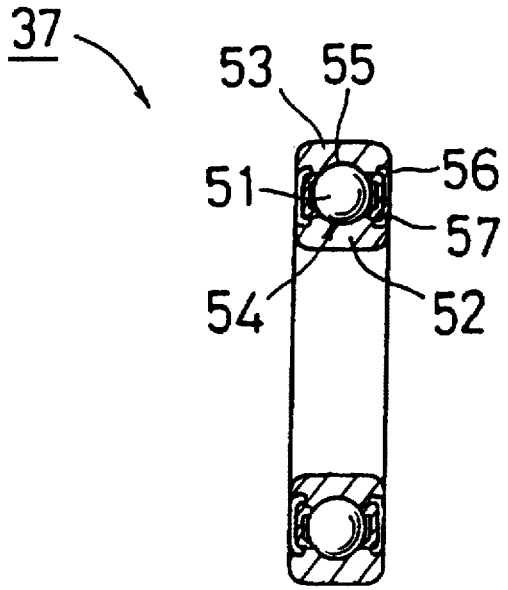
FIG. 3 is a sectional view showing a deep-groove ball bearing preferably used for the embodiment of FIG. 1.
Figure 4:
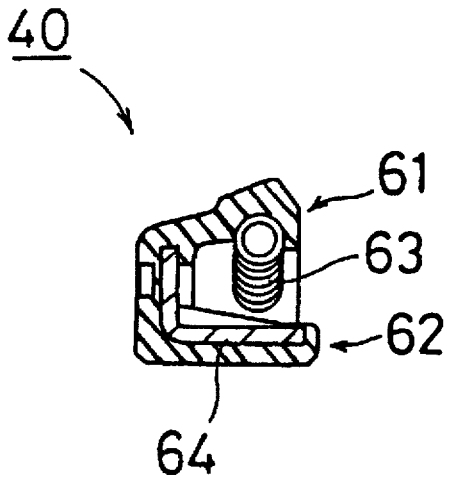
FIG. 4 is a sectional view showing a lip seal preferably used for the embodiment of FIG. 1.
Figure 5:
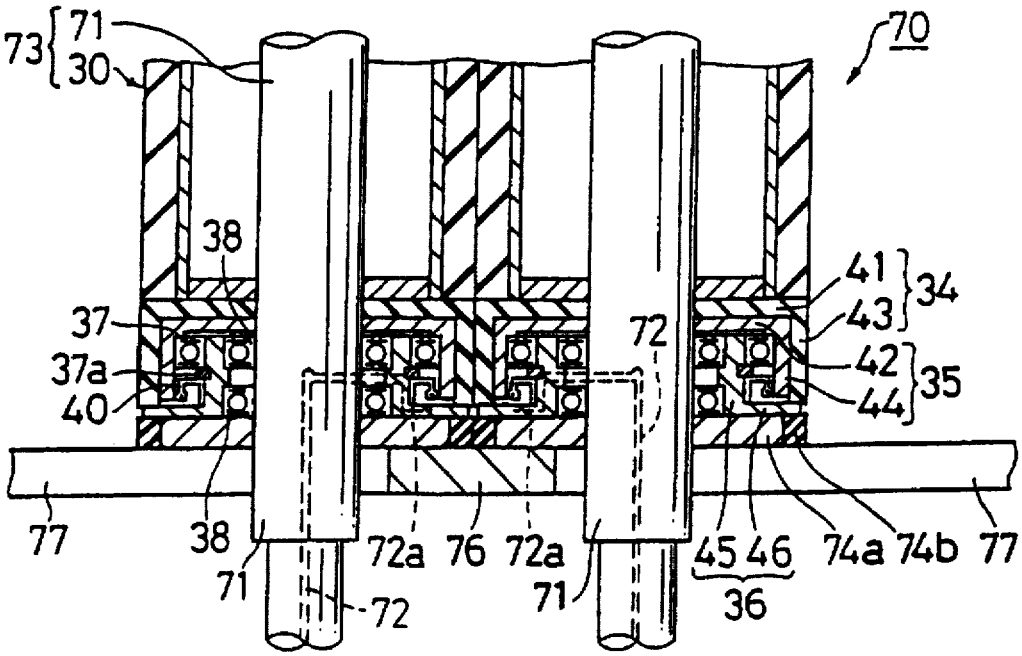
FIG. 5 is a schematic plan sectional view showing a second embodiment of the invention.
Figure 6:
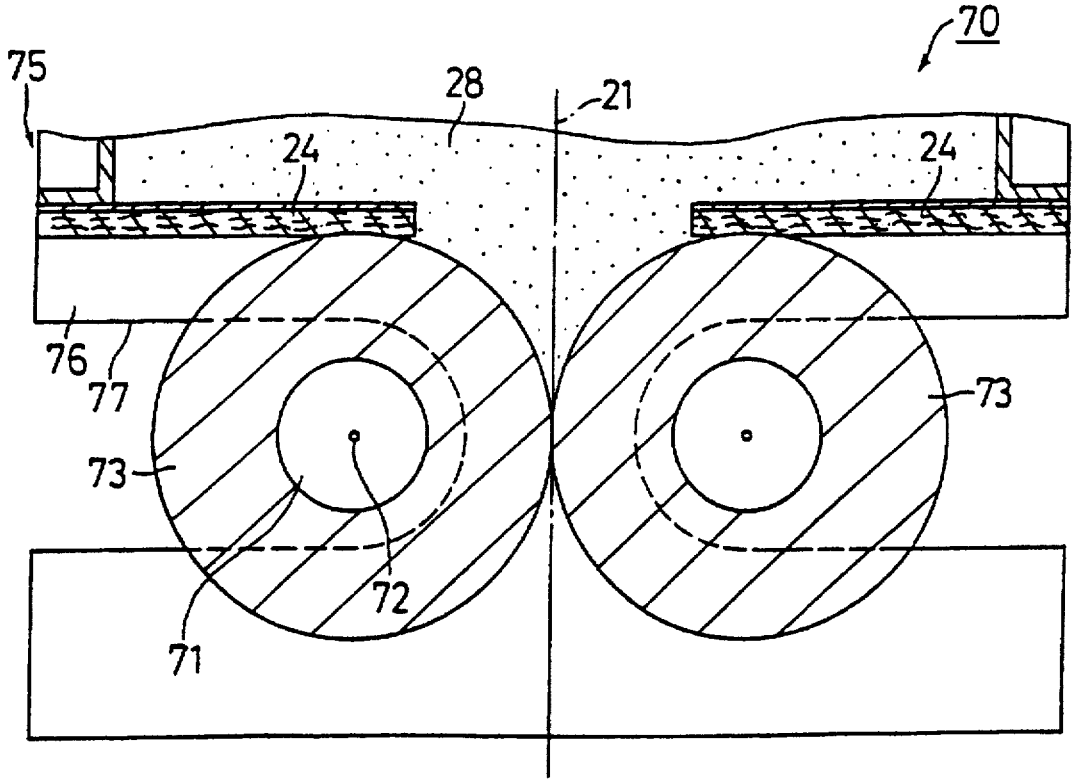
FIG. 6 is a front sectional view showing the embodiment of FIG. 5.
Figure 8:
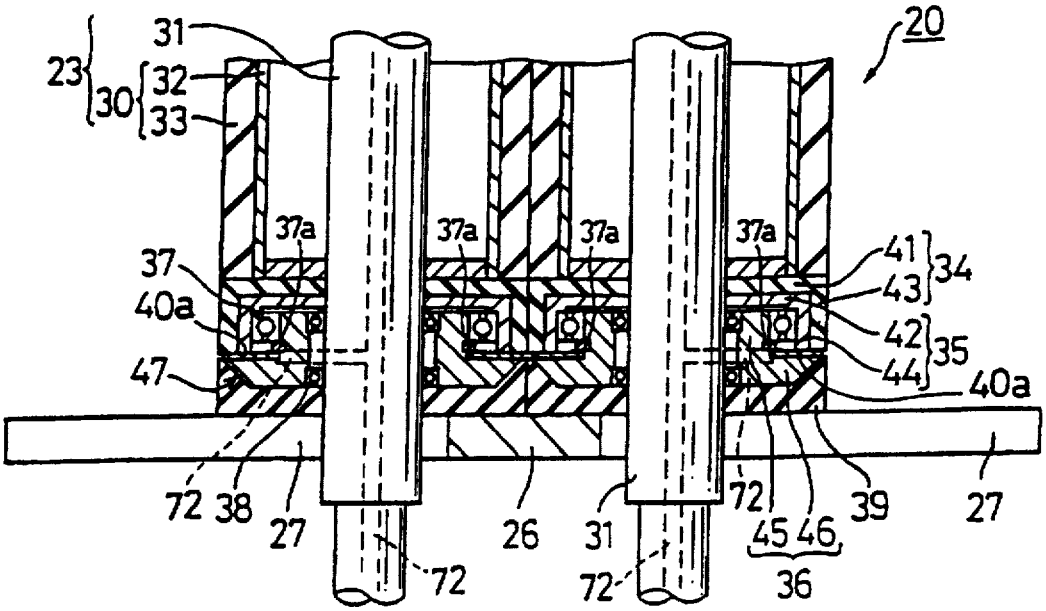
FIG. 8 is a schematic plan sectional view showing a third embodiment of the invention.
Figure 9:
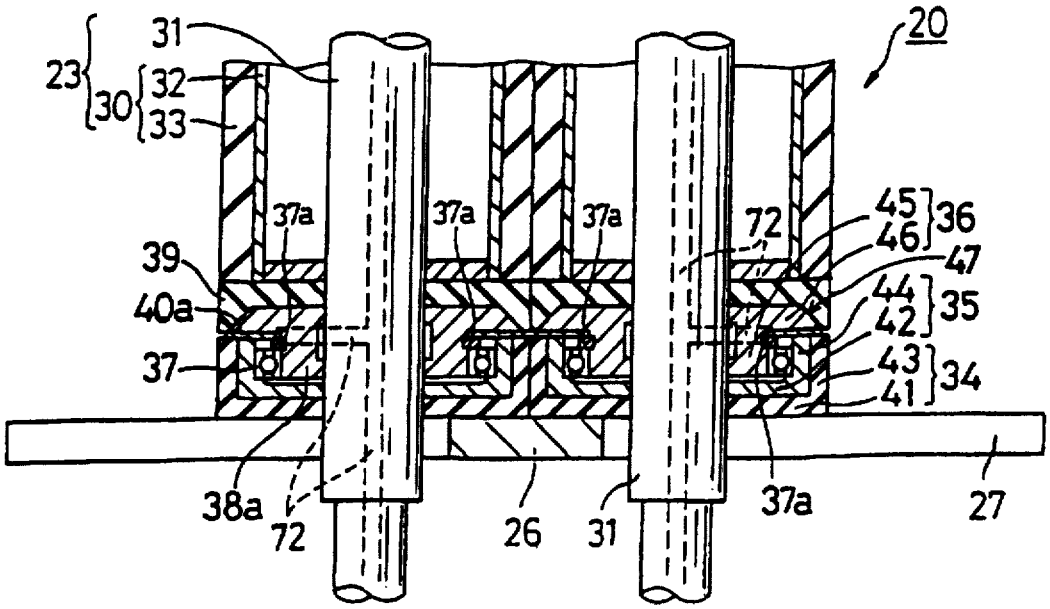
FIG. 9 is a schematic plan sectional view showing a fourth embodiment of the invention.
Figure 10:
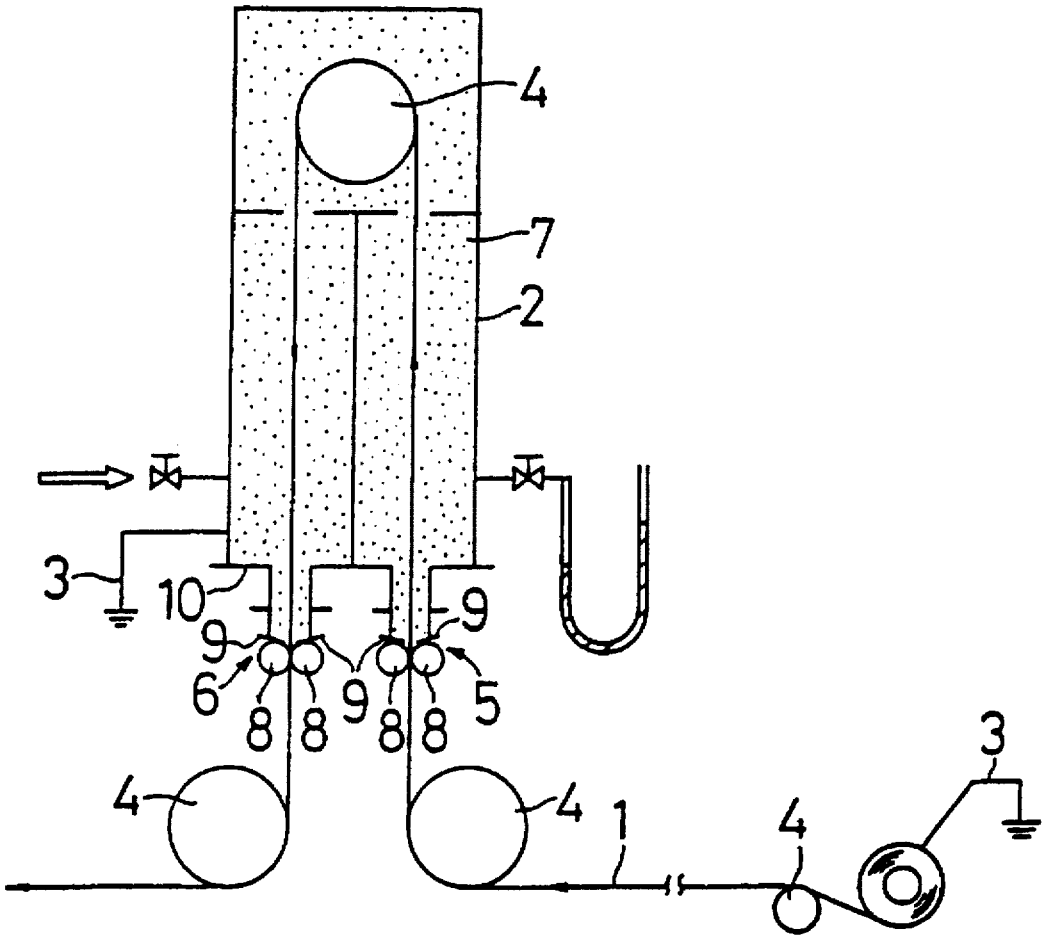
FIG. 10 is a schematic front sectional view showing a basic structure of a sealing apparatus for the inlet/outlet of an atmosphere facility.
Figure 11A:
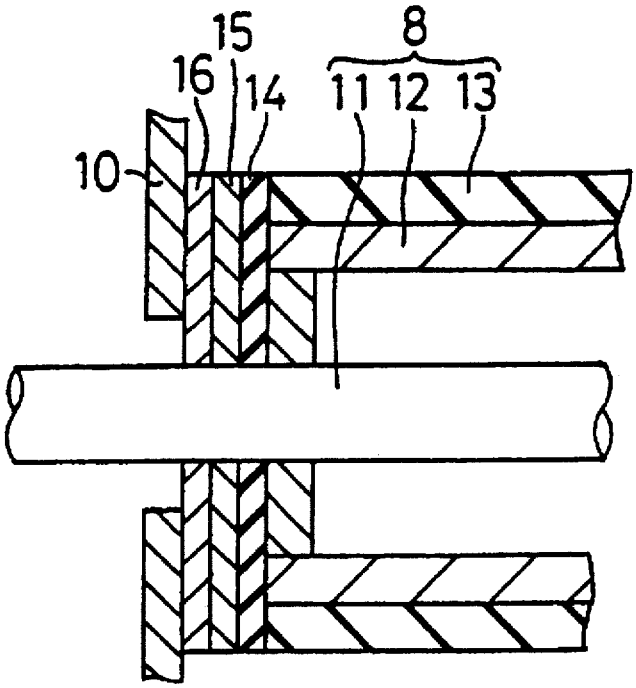
FIG. 11 is a schematic side sectional view showing a sealing structure at the end surface of an elastic roll of a prior art.
Figure 11B:
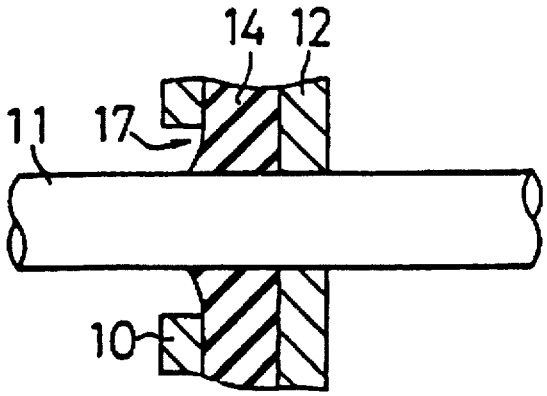

The embodiments of the present invention will be described below referring to FIGS. 1 to 9. FIGS. 1 and 2 show a structure of a first embodiment of the invention; FIG. 3 shows the structure of a ball bearing preferably used for the first embodiment; FIG. 4 shows the structure of a lip seal preferably used for the first embodiment; FIGS. 5 and 6 show a structure of a second embodiment of the invention; FIG. 7 schematically shows a piping system for atmosphere adjustment used for the second embodiment; FIG. 8 shows a structure of a third embodiment of the invention; and FIG. 9 shows a structure of a fourth embodiment.

FIG. 1 is a plan sectional view of a sealing apparatus 20 of the first embodiment and FIG. 2 is a front view of the sealing apparatus 20. The sealing apparatus 20 can be used at the inlet portion to be sealed of a bright annealing furnace 22, through which a metal strip 21 is taken in, and the apparatus can also be used in the same manner at the outlet portion to be sealed of the bright annealing furnace 22, through which the metal strip 21 is taken out.

The sealing apparatus 20 includes a pair of elastic rolls 23 for holding the metal strip 21 on both sides thereof, seal plates 24 contacting the outer peripheral surfaces of the elastic rolls 23, a casing 25 surrounding the elastic rolls 23 and the seal plates 24, and side walls 26. The boundary between the side wall 26 and the seal plate 24 is hermetically sealed. The elastic rolls 23 can be displaced along a guide groove 27 formed in the side wall 26. The seal plate 24 is made of an elastic material, such as nonwoven cloth. The interior of the bright annealing furnace 22 is filled with a combustible atmosphere gas 28 including hydrogen, such as pure hydrogen gas, a mixture gas containing 75% hydrogen gas and 25% nitrogen gas, for example, or an ammonia dissociated gas. The pressure of the gas is maintained at a positive pressure slightly higher, for example, by about 50 mm Aq, than the atmospheric pressure.

Roughly speaking, the elastic roll 23 comprises a roll body portion 30 and the shaft 31. The roll body portion 30 comprises a roll body 32 made of a rigid material, such as metal, and an elastic covering 33 disposed on the outer peripheral surface of the roll body 32.

Outwardly from the roll body portion 30 in the axial direction thereof, a covering member 34, a first supporting member 35, a second supporting member 36, an outer bearing 37, a retaining ring **37*a*, an inner bearing 38, an end surface sealing member 39, a lip seal 40 are disposed between the end of the roll and a side wall 26. Like the elastic covering 33, the covering member 34 and the end surface sealing member 39 are made of an elastic material selected from among silicone rubber, fluororubber, urethane rubber, EPDM, SBR, NBR, CR or the like, having a hardness of 40° to 90° specified in JIS K 6301 A and mixed with carbon black or the like so as to enhance mechanical characteristics and to attain electrical conductivity corresponding to a specific electric resistance in the range of 1 to $10^7$ Ω·cm to prevent electrostatic charge. When the elastic material has a specific electric resistance of more than $10^7$ Ω·cm, the elastic material is substantially the same as an insulator. This is improper. When the elastic material has a specific elastic resistance of less than 1 Ω·cm, sparking may occur from a charged body such as a human body having approached the facility to make inspection. Additionally, natural rubber, isoprene rubber, polysulfide rubber, butyl rubber acrylic rubber, hydrin rubber, chlorosulfonic polyethylene, chlorinated polyethylene or the like can also be used as an elastic material. The first supporting member 35 and the second supporting member 36** are made of rigid materials such as metal.

A first inward flange 41 of the covering member 34 and a second inward flange 42 of the first supporting member 35 contacts the end surface of the elastic roll 23. On the outer peripheral side of the first inward flange 41 of the covering member 34, the first sleeve 43 of the covering member 34 is formed so as to extend outwardly in the axial direction of the elastic roll 23. The second sleeve 44 of the first supporting member 35 is formed so as to extend outwardly in the axial direction of the elastic roll 23 from the outer periphery of the second inward flange 42. The outer peripheral surface of the second sleeve 44 contacts the inner peripheral surface of the first sleeve 43, and the length of the second sleeve 44 is slightly shorter than that of the first sleeve 43 so as to prevent the second sleeve 44 from making metal contact with the third outward flange 46 of the second supporting member 36. A third sleeve 45 of the second supporting member 36 is disposed between the second sleeve 44 and the shaft 31. On the inward side of the elastic roll 23 in the axial direction thereof, a space is provided between the end surface of the third sleeve 45 and the outer surface of the second inward flange 42. A third outward flange 46 extends outward in the radial direction thereof from the outward end of the third sleeve 45 in the axial direction of the elastic roll 23. The outer peripheral portion of the third outward flange 46 is formed as a tapered surface 47, the diameter of which decreases outwardly in the axial direction of the flange potion 46. The axially outer side of the third flange 46 is pushed against the side wall 26 via the end surface sealing member 39 and secured. At the axially inward outer peripheral portion of the third outward flange 46, the end surface of the first sleeve 43 of the covering member 34 rotates and slides so as to seal the space formed inwardly from the contact portion. The expression "inward" or "outward" used to describe the first, second and third flanges designates inward or outward with respect to the corresponding axial direction. However, the orientation of the flanges can be set either inward or outward.

Although the metal strip 21 appears to travel straight, actually it slightly snakes repeatedly. Therefore, the elastic roll 23 holding the metal strip 21 always receives thrust force in the axial direction of the roll due to repulsion force caused by the snaking of the metal strip 21. The thrust force is transmitted to the third sleeve 45 of the second supporting member 36 by the second inward flange 42 of the first supporting member 35 and the outer bearing 37 via the retaining ring 37*a* or a stepped portion (not shown) of the third sleeve 45. In other words, the positional relationship between the first supporting member 35 and the second supporting member 36 is determined by the outer bearing 37. No matter how the thrust force is changed, constant force (such as elastic repulsion force exerted at the end of the covering member 34) is applied to the portion where the end surface of the first sleeve 43 of the covering member 34 contacts the axially inward outer peripheral portion of the third outward flange 46 while rotating and sliding. The rotating and sliding contact portion is not affected by the thrust force generated by the snaking of the metal strip 21 or the thermal expansion of the elastic roll 23. Accordingly, stable sealing performance can be attained at the rotating and sliding contact portion at all times.

The outer diameter of the elastic covering 33 is basically identical to that of the covering member 34. The maximum diameter of the third outward flange 46 is made smaller by ΔD than the outer diameter of the elastic covering 33. When the maximum thickness of the metal strip 21 held by the elastic rolls 23 and the additional elastic rolls 26 is t, the relationship between ΔD and t is represented by $\Delta D \leqq t$.

Namely, when the metal strip 21 is held between the elastic rolls 23 disposed to face each other, the third outward flanges 46 disposed to face each other come into contact with each other. As a result, since the elastic rolls 23 are prevented from pushing the metal strip 21 and a clearance is formed between the elastic rolls 23 disposed to face each other, sealing performance of atmosphere gas is lowered. To prevent this problem, the relationship must be established. The smaller the value, the better. However, it is necessary to consider the deflection allowance of the shafts 31 when the metal strip 21 is held between the elastic rolls 23, it is also necessary to consider the deformation allowance of the elastic covering 33 of the elastic roll 23, the covering member 34 and the end surface sealing member 39 when their outer peripheries are pushed to attain sealing.

FIG. 3 schematically shows a structure of a deep-groove ball bearing preferably used as the outer bearing 37 shown in FIG. 1. This kind of single deep-groove ball bearing is the most typical type among rolling bearings. Steel balls 51 roll while being held between an inner race track 54 and an outer race track 55 formed on an inner race 52 and an outer race 53, respectively. Shields 56 are disposed on both sides of the row of the balls 51 in the axial direction of the bearing. In addition, a bearing wherein the space between the shields 56 is sealed with grease 57 is called a shield type. This type is low in friction torque and superior in high-speed performance, grease sealing performance and dust resistance. Furthermore, the deep-groove ball bearing can receive both radial and thrust forces simultaneously between the inner race 52 and the outer race 53. A shield type (ZZ type) equipped with seals made of steel seals, a non-contact rubber seal type equipped with rubber seals (VV type) or a contact rubber seal type equipped with rubber seals (DDU type) made by Nippon Seiko can be used as an example.

FIG. 4 shows the structure of a lip seal 40 shown in FIG. 1. The lip seal 40 is made of a material having flexible elasticity, such as NBR, and offers stable sealing function regardless of mechanical vibration and fluctuation in fluid pressure. Roughly speaking, the lip seal 40 has a seal lip portion 61 and a fitting portion 62. The seal lip portion 61 has a wedge shape, and the tip of the seal lip portion 61 hermetically seals a mating part while sliding and being displaced. A spring 63 is provided to push the tip of the seal lip portion 61 against the mating part. A metal ring 64 is embedded in the fitting portion 62 to offer a fitting force. Although the seal rip portion 61 is oriented outward and the fitting portion 62 is oriented inward in the embodiment, the orientations may be reversed.

FIG. 5 is a plan sectional view in accordance with the second embodiment of the invention and FIG. 6 is a front view of the embodiment. The same reference numerals designate the corresponding parts in the first embodiment. In the sealing apparatus 70 of the second embodiment, a vent hole 72 used as a gas flow line is formed in a roll shaft 71, one to several vent holes are disposed from the inside to the outside of the third sleeve, and a vent line 72a is formed to allow gas to flow from the vent hole 72 by making grooves on the outer periphery of the third sleeve from the vent holes of the third sleeve to the inner surface of the third outward flange. With this structure, the atmosphere in the space formed inwardly from the rotating/sliding contact portion between the second supporting member 36 and the covering member 34 at both ends of the elastic roll 73 can be adjusted via the vent hole 72 by externally raising or lowering the pressure. Furthermore, as the end surface sealing member, a combination of a rigid washer 74a and an elastic ring 74b is used. The rigid washer 74a is made of a Teflon resin and the elastic ring 74b made of a rubber material is attach to the outer peripheral surface of the rigid washer 74a. Both the rigid washer 74a and the elastic ring 74b should preferably have a specific electric resistance in the range of 1 to $10^7$ Ω·cm to prevent sparking which might be caused in the event of electrostatic charge. A material known under the trade name of "EXCELITE" made by "Nichiasu" can be suitably used for the rigid washer 74a. The guide groove 77 disposed in the side wall 76 of the casing 75 is formed linearly. When the shaft 71 moves along the guide groove 77, the rigid washer 74a has low friction resistance when the washer is made of a Teflon resin, thereby facilitating the maintenance of the sealing apparatus 70. Although no tapered surface is provided on the outer peripheral portion of the third outward flange 46 of the second supporting member 36, since the elastic ring 74b protrudes from the axially outward portion thereof and the covering member 34 is elastically deformed and protrudes from the axially inward portion thereof into the space formed between the outer peripheral portions of the third outward flanges facing each other when the metal strip 21 is held between the rolls, the sealing performance is enhanced and the atmosphere can be adjusted via the vent hole 72. A metal plate coated with a Teflon resin may be used for the rigid washer 74a.

Figure 7A:
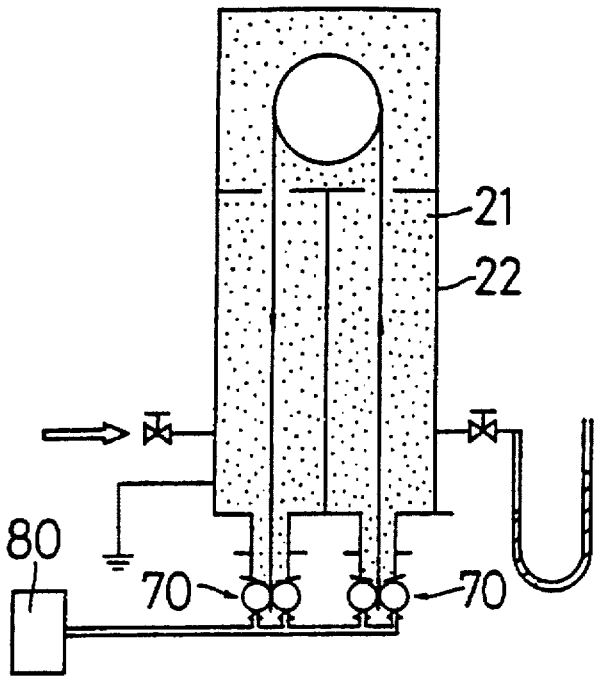
FIG. 7 is a schematic piping system diagram for an atmosphere facility preferably used for the embodiment of FIG. 5.
Figure 7B:
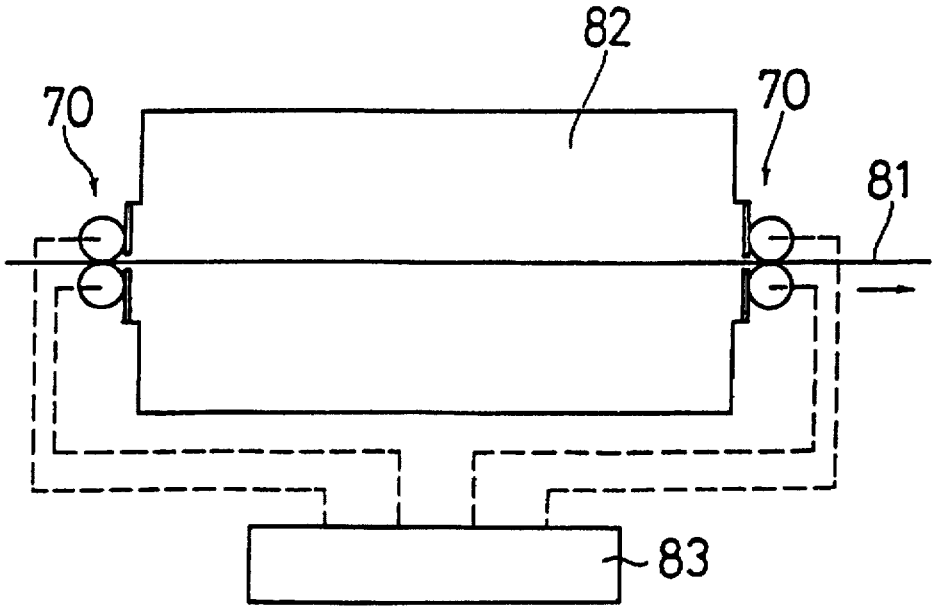

FIG. 7 shows a structure for adjusting the atmosphere in the sealing apparatus 70 shown in FIG. 6. In FIG. 7A, nitrogen ($N_2$), an inert gas such as argon (Ar) or a gas similar to the furnace atmosphere is supplied from an atmosphere gas supplying device 80 so as to prevent oxygen or the like from entering the bright annealing furnace 22 or the like in which an atmosphere gas having the danger of causing explosions and fires is used. In FIG. 7B, a vacuum suction device 83 performs suction to enhance the sealing performance at the inlet/outlet portion of a horizontal vacuum evaporation furnace 82 used as an atmosphere treatment facility through which a synthetic resin film 81 is passed as a strip. By the vacuum suction, the vacuum in the vacuum evaporation furnace 82 is maintained properly and high-quality vacuum evaporation can be attained stably.

FIG. 8 shows the structure in accordance with the embodiment of the invention. The same numerals designate the corresponding parts in the first embodiment. Outwardly from the roll body portion 30 in the axial direction thereof, a covering member 34, a first supporting member 35, a second supporting member 36, an outer bearing 37, a retaining ring 37a, an inner bearing 38, an end surface sealing member 39, a seal disc 40a are disposed between the end of the roll and a side wall 26. Like the elastic covering 33, the covering member 34 and the end surface covering 33, the covering member 34 and the end surface sealing member 39 are made of an elastic material selected from among silicone rubber, fluororubber, urethane rubber, EPDM, SBR, NBR, CR or the like, having a hardness of 40° to 90° specified in JIS K 6301 A and mixed with carbon black or the like so as to enhance mechanical characteristics and to attain electrical conductivity corresponding to a specific electric resistance in the range of 1 to $10^7$ Ω·cm to prevent electrostatic charge. When the elastic material has a specific electric resistance of more than $10^7$ Ω·cm, the elastic material is substantially the same as an insulator. This is improper. When the elastic material has a specific elastic resistance of less than 1 Ω·cm, sparking may occur from a charged body such as a human body having approached the facility to make inspection. Additionally, natural rubber, isoprene rubber, butyl rubber, polysulfide rubber, acrylic rubber, hydrin rubber, chlorosulfonic polyethylene, chlorinated polyethylene or the like can also be used as an elastic material. The first supporting member 35 and the second supporting member 36 are made of rigid materials such as metal.

A first inward flange 41 of the covering member 34 and a second inward flange 42 of the first supporting member 35 contact the end surface of the elastic roll 23. On the outer peripheral side of the first inward flange 41 of the covering member 34, the first sleeve 43 of the covering member 34 is formed so as to extend outwardly in the axial direction of the elastic roll 23. The second sleeve 44 of the first supporting member 35 is formed so as to extend outwardly in the axial direction of the elastic roll 23 from the outer periphery of the second inward flange 42. The outer peripheral surface of the second sleeve 44 contacts the inner peripheral surface of the first sleeve 43, and the length of the second sleeve 44 is slightly shorter than that of the first sleeve 43 so as to prevent the second sleeve 44 from making metal contact with the third outward flange 46 of the second supporting member 36. Between the second sleeve 44 and the flange portion 46, a seal disc 40a having a thickness of about 1 to 2 mm and made of Teflon (PTFE) or mainly composed of Teflon is disposed. One or two seal discs 40a (not shown) may be used. When two pieces of the seal discs 40a are used, electrostatic charge may occur due to slip between the two seal discs 40a. To prevent this problem, the specific electric resistance should preferably be in the range of 1 to $10^7$ Ω·cm because of the reason described in the case of the covering 34. A third sleeve 45 of the second supporting member 36 is disposed between the second sleeve 44 and the shaft 31. On the inward side of the elastic roll 23 in the axial direction thereof, a space is provided between the end surface of the third sleeve 45 and the outer surface of the second inward flange 42. A third outward flange 46 extends outward in the radial direction thereof from the outward end of the third sleeve 45 in the axial direction of the elastic roll 23.

The outer peripheral portion of the third outward flange 46 is formed as a tapered surface 47, the diameter of which decreases outwardly in the axial direction of the flange potion 46. The axially outer side of the third flange 46 is pushed against the side wall 26 via the end surface sealing member 39 and fixed. At the axially inward outer peripheral portion of the third outward flange 46, the end surface of the first sleeve 43 of the covering member 34 pushes the seal disc 40a only by using the elastic repulsion force generated at the end of the covering member 34 instead of the thrust force of the roll, and the seal disc 40a contacts the third outward flange portion 46 while rotating and sliding so as to seal the space formed inwardly from the contact portion. Furthermore, a vent hole 72 used as a gas flow line is formed in the roll shaft 31, and one or several vent holes 72 are formed from the inside to the outside of the third sleeve 45. With this structure, the atmosphere in the sealed space can be adjusted by externally increasing or decreasing the pressure, whereby stable sealing can be attained. The outer diameter of the elastic covering 33 is basically identical to that of the covering member 34. The maximum diameter of the third outward flange 46 and the seal disc 40*a* are made smaller by ΔD than the outer diameter of the elastic covering 33. When the maximum thickness of the metal strip 21 held between the elastic rolls 23 is t, the relationship between ΔD and t is represented by $\Delta D \leqq t$. In case this relationship is not established, when the elastic rolls 23 disposed to face each other hold the metal strip 21, the third outward flanges 46 and the seal discs 40*a* disposed to face each other come into contact with each other. As a result, the elastic rolls 23 are prevented from pushing the metal strip 21, a clearance is formed between the elastic rolls 23 disposed to face each other, and the sealing performance of the atmospheric is lowered. To prevent this problem, the relationship must be established.

FIG. 9 shows a structure of the fourth embodiment of the invention. The same numerals designate the same parts corresponding to the first embodiment and the second embodiment. The basic structure of the fourth embodiment is obtained by interchanging the roll-side parts with the anti-roll-side parts of the third embodiment. Although the inner bearing 38 (not shown) may be used, the third sleeve 45 may be mounted directly on the shaft 31 as shown in FIG. 9. A fitting portion 38*a* is formed at positions corresponding to the positions of the inner bearing 38 in accordance with the first, the second or the third embodiment by machining the third sleeve 45. With this structure, the inner bearings 38 can be omitted, thereby reducing parts count, ensuring economy and simplifying assembly. The functions of the parts are not described here since they are identical to those used for the third embodiment.

Although the vertical bright annealing furnace 22 and the horizontal vacuum evaporation furnace 82 are explained as atmosphere facilities in the above-mentioned embodiments, either the vertical or horizontal facility may be used. Furthermore, the atmosphere facility is not limited to bright annealing facilities and vacuum evaporation furnaces but organic solvent handling facilities, such as painting apparatuses and cleaning apparatuses, operated under a pressure lower than the atmospheric pressure may be used. Since stable rotation resistance is obtained by a bright annealing furnace in particular, the tension control of the metal strip being red-hot in the furnace is not disturbed. Therefore, the shape of the metal strip after heat treatment is improved and the quality of the metal strip is enhanced. Moreover, the number of sliding sealing portions are reduced significantly, thereby capable of preventing friction of parts and attachment of friction powder.

INDUSTRIAL UTILITY

As described above, according to the present invention, since sealing is performed by elastic members and rotation loads are supported by bearings between the end surface of the elastic roll and the side wall of the casing, the sealing performance of the sealing apparatus can be enhanced easily while the rotation loads are reduced. Furthermore, since stable rotation resistance is obtained, the tension control of the strip can be performed stably without disturbance, whereby the quality of the strip atmosphere-treated can be enhanced.

Furthermore, according to the invention, the end surface sealing member and the covering member made of elastic materials protrude into the space formed between the third flanges of the second supporting members disposed to face each other, whereby reliable sealing can be attained. Consequently, the leak of the atmosphere gas is limited and the production cost for atmosphere treatment of the strip can be reduced.

Furthermore, according to the invention, the lip seal is used to enhance the sealing performance at the end surface of the elastic roll.

Furthermore, according to the invention, the deep-groove ball bearing itself is used to perform sealing while the rotation loads of the elastic roll are reduced, whereby the sealing performance can be enhanced. When compared with the prior art, the invention is advantageous in that: (1) since the number of sliding sealing portions is reduced significantly, friction powder of sealing members, a leading cause of staining the strip, is not generated, whereby the quality of the strip is enhanced; (2) since parts are hardly worn by sliding when compared with the parts according to the prior art, operation can be continued for an extended period of time, whereby productivity can be increased.

Furthermore, according to the invention, an inert gas or a as similar to the furnace atmosphere is sealed and adjusted in the space formed inwardly from the contact portion of the third flange of the stationary second supporting member and the first sleeve of the rotating covering member so as to securely prevent the atmosphere gas in the atmosphere facility from leaking to the outside air and to securely prevent the outside air from entering the atmosphere facility. Moreover, since the inert gas passes through the rotating /sliding contact portion, the gas forms a kind of fluid seal and the coefficient of friction is lowered. Besides, since cooling is performed by the gas, the sealing is made stable without causing heat generation during high-speed operation. Consequently, productivity can be increased by high-speed operation.

Furthermore, according to the invention, since the atmosphere gas including hydrogen or the like and having the danger of causing explosions and fires can be securely shut off from the outside air, the safety of operation is enhanced.

Furthermore, in accordance with the invention, since the metal strip can be subjected to bright annealing safely and stably, and the rotation resistance of the elastic roll is made stable, no disturbance occurs when the tension applied to the metal strip in the red-hot furnace is controlled to be stabilized, thereby delivering the metal strip superior in shape and quality after heat treatment. In the case of the prior art, the friction washer and the rubber washer are rubbed with each other by the thrust force and the roll rotation force, and distorted, deformed and charged electrostatically. However, in the case of the invention, no distortion, deformation or electrostatic charge is caused, whereby the safety of operation against the danger of causing ignition due to electrostatic sparking is enhanced.

Furthermore, according to the invention, since the space formed inwardly from the contact portion of the third flange of the stationary second supporting member and the first sleeve of the rotating covering member is evacuated, the outside air is securely prevented from entering the atmosphere facility when the pressure in the atmosphere facility is lower than that of the atmospheric air.

Furthermore, according to the invention, the outside air is prevented from entering an organic solvent handling facility being operated under reduced pressure, whereby safe operation can be continuously and stably conducted.

Furthermore, according to the invention, since the strip can be passed through continuously while a high vacuum is maintained, vacuum evaporation can be performed efficiently and stably, whereby a vacuum evaporation film of high quality can be formed on the strip.

Furthermore, according to the invention, electrostatic charge due to sliding friction at the sealing portions at both ends of the roll is prevented, whereby a combustible gas can be safely sealed.

Furthermore, according to the invention, the ends of the elastic roll can be sealed safely and securely by using a rubber-based elastic member provided with electrical conductivity.

What is claimed is:

1. A sealing apparatus for hermetically sealing the inlet or the outlet of an atmosphere facility for atmosphere-treating a strip while holding the strip between a pair of rolls at least whose outer surface is made elastic, the sealing apparatus comprising:

a casing for enclosing the pair of rolls;

a seal plate for sealing the boundary between the casing and each of the pair of elastic rolls by elastically contacting the outer peripheral surfaces of the pair of elastic rolls;

covering members, formed of an elastic material, comprising a first flange contacting the end surfaces of the rolls and a first sleeve extending outwardly from the outer peripheral surface of the first flange in the axial direction of the rolls, the covering members being incorporated as members of a roll end seal apparatus and disposed on both ends of each roll;

first supporting members disposed on both ends of each roll and formed of a rigid material, each first supporting member comprising a second flange which makes a junction with the outer surface of the first flange, and a second sleeve extending outwardly from the outer peripheral surface of the second flange in the axial direction of the rolls;

second supporting members disposed on both ends of each roll and formed of a rigid material, each second supporting member comprising a third sleeve arranged between the shaft of each roll and the second sleeve outwardly from the second flange in the axial direction of the rolls and a third flange extending from the outer end surface of the third sleeve in the axial direction of the roll to the radial direction of the rolls;

outer bearings each interposed between the third sleeve and the second sleeve, which receive radial and thrust forces, the outer bearing being disposed on both ends of each roll;

inner bearings each interposed between the third sleeve and the shaft of each roll; and an end surface sealing member interposed between the side wall of the casing and the third flange of the second supporting member at both ends of each roll, at least the outward side of which in the radial direction of the roll is formed of an elastic material.

2. The sealing apparatus for sealing the inlet and/or the outlet of an atmosphere facility of claim 1, wherein the third flange of the second supporting member has a tapered surface on the outer periphery with the diameter of the surface decreasing in the axially outward direction of the roll.

3. The sealing apparatus for sealing the inlet and/or the outlet of an atmosphere facility of claim 1, wherein a lip seal for sealing the boundary between the third sleeve and the second sleeve is provided between the third sleeve of the second supporting member and the second sleeve of the first supporting member outwardly from the outer bearing in the axial direction of the roll.

4. The sealing apparatus for sealing the inlet and/or the outlet of an atmosphere facility of claim 1, wherein the outer bearing is a deep-groove ball bearing.

5. The sealing apparatus for sealing the inlet and/or the outlet of an atmosphere facility of claim 1, further comprising means for injecting an inert gas or a gas similar to the atmosphere gas of the furnace into space formed inwardly from the portions where the third flanges of the second supporting members, connected to the side wall surface via the end surface sealing member, slidingly contacts the covering members rotating together with the rolls during rotation, via gas passages provided in the shafts of the rolls.

6. The sealing apparatus for sealing the inlet and/or the outlet of an atmosphere facility of claim 1, wherein the atmosphere facility is filled with a combustible atmosphere gas including hydrogen gas under a pressure slightly higher than the atmospheric pressure.

7. The sealing apparatus for sealing the inlet and/or the outlet of an atmosphere facility of claim 1, wherein the strip is a metal strip and the atmosphere facility is a bright annealing furnace.

8. The sealing apparatus for sealing the inlet and/or the outlet of an atmosphere facility of claim 1, further comprising means for conducting vacuum suction of spaces formed inwardly from the portions where the third flanges of the second supporting members, connected to the side wall surface via the end surface sealing member, slidingly contacts the covering members rotating together with the rolls during rotation, via gas passages provided in the shafts of the rolls.

9. The sealing apparatus for sealing the inlet and/or the outlet of an atmosphere facility of claim 1, wherein the atmosphere facility is an organic solvent handling facility operated under a pressure lower than the atmospheric pressure.

10. The sealing apparatus for sealing the inlet and/or the outlet of an atmosphere facility of claim 1, wherein the atmosphere facility is a vacuum evaporation furnace.

11. The sealing apparatus for sealing the inlet and/or the outlet of an atmosphere facility of claim 1, wherein the covering member and the end surface sealing member are mainly made of elastic members having a specific electric resistance in the range of 1 to $10^7$ Ω·cm.

12. The sealing apparatus for sealing the inlet and/or the outlet of an atmosphere facility of claim 11, wherein the elastic member is made of natural rubber, isoprene rubber, SBR, NBR, CR, butyl rubber, polysulfide rubber, silicone rubber, fluororubber, urethane rubber, chlorosulfonic polyethylene, chlorinated polyethylene, butadiene rubber, EPDM, acrylic rubber or hydrin rubber.

* * * * *